US005772360A

United States Patent [19]

Wood, II

[11] Patent Number: 5,772,360

[45] Date of Patent: Jun. 30, 1998

[54] TOPLESS WATERCRAFT LIFTING APPARATUS WITH A DIFFERENTIAL GEARING SYSTEM

[76] Inventor: Donald M. Wood, II, P.O. Box 2737, Stuart, Fla. 34995

[21] Appl. No.: 848,721

[22] Filed: May 19, 1997

[51] Int. Cl.[6] ..... E63C 3/06

[52] U.S. Cl. ..... 405/3; 114/48; 187/213; 254/286; 254/311

[58] Field of Search ..... 405/3; 114/44, 114/45, 46, 47, 48, 263; 187/213, 256, 259; 254/286, 295, 311, 299

[56] References Cited

U.S. PATENT DOCUMENTS

| | | | |
|---|---|---|---|
| 1,868,043 | 7/1932 | Barclay . | |
| 2,211,088 | 8/1940 | Arnold . | |
| 2,249,900 | 7/1941 | Honig | 187/259 X |
| 3,191,389 | 6/1965 | Poe . | |
| 3,265,024 | 8/1966 | Kramlich . | |
| 3,504,502 | 4/1970 | Blount . | |
| 3,614,066 | 10/1971 | Day | 254/299 |
| 3,675,258 | 7/1972 | Osmundson . | |
| 3,697,048 | 10/1972 | Sarno . | |
| 3,778,855 | 12/1973 | Kariagin et al. . | |
| 3,791,229 | 2/1974 | Litezki . | |
| 3,837,502 | 9/1974 | Hornagold . | |
| 4,337,868 | 7/1982 | Gattu . | |
| 4,589,800 | 5/1986 | Nasby, Jr. . | |
| 4,641,996 | 2/1987 | Seal . | |
| 4,686,920 | 8/1987 | Thomas . | |
| 4,832,210 | 5/1989 | Wood, II . | |
| 4,954,011 | 9/1990 | Stenson . | |
| 4,955,308 | 9/1990 | Craddock . | |
| 4,983,067 | 1/1991 | Montgomery . | |
| 5,020,463 | 6/1991 | Franklin et al. . | |
| 5,051,027 | 9/1991 | Horton . | |
| 5,090,842 | 2/1992 | Montgomery . | |
| 5,140,923 | 8/1992 | Wood . | |
| 5,184,914 | 2/1993 | Basta . | |
| 5,211,124 | 5/1993 | Reiser . | |
| 5,261,347 | 11/1993 | Mansfield . | |
| 5,275,505 | 1/1994 | Wilcox . | |
| 5,287,821 | 2/1994 | Godbersen . | |
| 5,390,616 | 2/1995 | Roth . | |
| 5,427,471 | 6/1995 | Godbersen | 405/3 |
| 5,482,401 | 1/1996 | Spisak . | |
| 5,485,798 | 1/1996 | Samoian et al. . | |
| 5,558,034 | 9/1996 | Hodapp . | |
| 5,562,362 | 10/1996 | Vezner . | |
| 5,593,247 | 1/1997 | Endres et al. . | |

*Primary Examiner*—Tamara L. Graysay
*Assistant Examiner*—Jong-Suk Lee
*Attorney, Agent, or Firm*—Sperry, Zoda & Kane

[57] ABSTRACT

A watercraft lifting apparatus utilizing a lifting beam vertically movable within a frame preferably including pile members defining a watercraft receiving slot. The lifting beam is vertically movable to contact preferably the lower surface of the watercraft for moving it upwardly. The movement of the lifting beam is powered by a main drive connected through the lifting apparatus by two winching and cable devices. First an outer winch powers retraction and extension of an outer cable connected through a pulley configuration to the distal end of the lifting beam. Also an inner winching device is operable to extend and withdraw an inner cable operatively connected through a pulley configuration to the proximate end of the lifting beam to assure that the lifting beam is lifted vertically in a horizontal orientation to facilitate lifting of the watercraft such as for cleaning and/or storage thereof. A differential gearing mechanism is included in the present invention which is operative to receive driving power from the main drive for powering operation of the inner and outer winching drums at different speeds such that they are capable of winding the inner and outer cables at different speeds. The ratio of speed of operation of the two winches has a proportion dependent upon the mechanical configuration of the pulley design utilized for carrying the inner and outer cables during vertical movement of the lifting beam.

27 Claims, 4 Drawing Sheets

TOPLESS WATERCRAFT LIFTING APPARATUS WITH A DIFFERENTIAL GEARING SYSTEM

BACKGROUND OF THE INVENTION

1. Field of the Invention

The present invention deals with the field of devices for lifting watercraft above water level for various purposes such as for drydock cleaning or storage such as during off-season. Normally such watercraft lifting apparatus are designed for use with small to intermediate sized pleasure watercraft but can be utilized for any type of watercraft whatsoever including dinghies, rafts, small or large boats, jet skis or any other watercraft in the most generalized sense.

Movement of these watercraft to an elevated position above water level is desirable often for the purposes of maintenance, cleaning, storage, safety during adverse weather conditions and any other circumstances which may arise wherein removal of the watercraft from a body of water is deemed necessary.

2. Description of the Prior Art

Numerous prior art device have been designed for the purposes of lifting watercraft from a body of water such as shown in U.S. Pat. No. 3,191,389 patented Jun. 29, 1965 to J. B. Poe on a "Boat Lift"; and U.S. Pat. No. 3,265,024 patented Aug. 9, 1966 to C. W. Kramlich on a "Boat Lift"; and U.S. Pat. No. 3,504,502 patented Apr. 7, 1970 to L. H. Blount on a "Lift Dock For A Water Corne Vessel"; and U.S. Pat. No. 3,697,048 patented Oct. 10, 1972 to R. Sarno on "Boat Hoists"; and U.S. Pat. No. 3,791,229 patented Feb. 12, 1974 to H. Litezki and assigned to Schiess Aktiengesellschaft on a "Lifting Device For Lifting And Lowering Heavy Loads"; and U.S. Pat. No. 4,589,800 patented May 20, 1986 to C. Nasby, Jr. on a "Dock Structure And Method And Apparatus For Raising And Lowering Same"; and U.S. Pat. No. 4,686,920 patented Aug. 18, 1987 to J. Thomas on "Cradle Type Boat Lifts"; and U.S. Pat. No. 4,954,011 patented Sep. 4, 1990 to S. Stenson on a "Powered Method And Apparatus For Lifting A Boat"; and U.S. Pat. No. 4,955,308 patented Sep. 11, 1990 to G. Craddock on a "Floating Boat Lift"; and U.S. Pat. No. 4,983,067 patented Jan. 8, 1991 to D. Montgomery on a "Boat Lift Apparatus"; and U.S. Pat. No. 5,020,463 patented Jun. 4, 1991 to R. Franklin et al on an "Arrangement For Raising Or Lowering Boats Or The Like"; and U.S. Pat. No. 5,051,027 to G. Horton patented on Sep. 24, 1991 on a "Boat Lift"; and U.S. Pat. No. 5,090,842 patented Feb. 25, 1992 to D. Montgomery on a "Boat Lift Apparatus And System"; and U.S. Pat. No. 5,140,923 patented Aug. 25, 1992 to K. Wood on a "Raising And Lowering Device"; and U.S. Pat. No. 5,184,914 patented Feb. 9, 1993 to S. Basta on a "Lift For Watercraft"; and U.S. Pat. No. 5,211,124 patented May 18, 1993 to J. Reiser and assigned to Triton Corporation on a "Winch Construction For Boat Lift"; and U.S. Pat. No. 5,261,347 patented Nov. 16, 1993 to P. Mansfield on a "Sailboat Davit"; and U.S. Pat. No. 5,275,505 patented Jan. 4, 1994 to P. Wilcox and assigned to Waterfront Construction, Inc. on a "Locking System For Boat Water-Lifts"; and U.S. Pat. No. 5,287,821 patented Feb. 22, 1994 to B. Godbersen on an "Electric Drive Mechanism For Boat Hoist Winch"; and U.S. Pat. No. 5,390,616 patented Feb. 21, 1995 to H. Roth on a "Dock Mounted Small Boat Lifting System"; and U.S. Pat. No. 5,482,401 patented Jan. 9, 1996 to J. Spisak on a "Boat-Lift Apparatus"; and U.S. Pat. No. 5,485,798 patented Jan. 23, 1996 to R. Samoian et al on a "Boat Lift"; and U.S. Pat. No. 5,558,034 patented Sep. 24, 1996 to G. Hodapp on a "Lift Transportable With Pontoon Boats Or The Like"; and U.S. Pat. No. 5,562,362 patented Oct. 8, 1996 to K. Vezner on a "Retractable Transport Wheel Mechanism For Boat Lifts"; and U.S. Pat. No. 5,593,247 patented Jan. 14, 1997 to J. Endres et al and assigned to Endcor Inc. on a "Programmable Boat Lift Control System".

SUMMARY OF THE INVENTION

The present invention provides a watercraft lifting apparatus which has an open top or topless configuration which includes a main frame defining a watercraft receiving slot therein designed to receive watercraft immediately prior to lifting thereof. The main frame preferably includes an outer piling and an inner piling which are spatially disposed from one another on either opposite side of the watercraft receiving slot.

A lifting means is preferably movably mounted within the main frame and extends laterally across the watercraft receiving slot therebelow such as to be vertically movable upwardly. This lifting means preferably includes a watercraft support device positionable immediately below a watercraft positioned within the watercraft receiving slot and adapted to be placed in abutment therewith for facilitating lifting of the watercraft responsive to lifting of the lifting beam itself. The lifting beam preferably will define a proximate beam end thereon adjacent to the inner piling and a distal beam end thereon spatially disposed from the proximate beam end and positioned adjacent the outer piling. The watercraft support device will preferably be located on the lifting beam with the proximate beam end on one side thereof and the distal beam on the other side thereof.

A main drive is also included which is preferably secured to the main frame. A lifting apparatus is attached with respect to the main frame and is operationally attached to the lifting beam and the main drive for facilitating vertical movement of the lifting beam being responsive to operation of the main drive. The lifting beam preferably defines a lateral channel extending therethrough. The lifting device itself preferably includes an inner cable operatively attached with respect to the proximate beam end of the lifting beam to facilitate lifting. The cable is preferably secured with respect to an inner winch which is operative for winding and unwinding thereof in order to facilitate control of lifting of the proximate beam end of the lifting beam. Preferably the inner winch also includes an inner cable winding drum. The inner winching device is preferably secured to the inner piling.

In a similar manner an outer cable is operatively attached with respect to the distal beam of the lifting beam to facilitate lifting thereof. An outer winch is operatively attached to this outer cable for selectively winding and unwinding thereof to facilitate control of lifting of the distal beam end of the lifting beam. The outer winch is preferably secured to the inner piling. The outer winch also preferably includes an outer cable winding drum which is preferably vertically oriented above the inner cable winding drum to facilitate control of lifting of the lifting beam. In the preferred configuration the outer cable winding drum is positioned immediately above or below the inner cable winding drum to further facilitate control of lifting beam movement.

An inner main pulley is preferably included rotatably secured to the lifting beam adjacent the proximate beam end thereof. The inner cable is preferably positioned extending from the inner cable winding drum around the inner main pulley in order to be fixedly secured to the main frame thereabove and in this manner facilitate vertical movement of the proximate beam end of the lifting beam.

An outer pulley assembly is also preferably included for facilitating vertical movement of the distal beam end of the lifting beam. This outer pulley assembly preferably includes an outer main pulley rotatably secured to the frame above the distal beam end of the lifting beam. The outer main pulley is preferably rotatably secured to the outer piling. A distal beam pulley is also included rotatably secured to the lifting beam within the lateral channel thereof adjacent the distal beam end thereof. Also a proximate beam pulley is rotatably secured to the lifting beam within the lateral channel thereof adjacent the proximate beam end thereof. The outer cable itself is preferably positioned extending from the outer cable winding drum around the proximate beam pulley through the lateral channel to and around the distal beam pulley and around the outer main pulley to then be attached to the lifting beam at a position adjacent to the distal beam end thereof in order to facilitate vertical movement thereof.

A differential gearing assembly is included operatively connected to the main drive and also operatively connected separately to the inner winching device and the outer winching device. In this manner it facilitates driving of both winches separately. The differential gearing device is preferably responsive to operation of the main drive to drive the outer winch at a speed defined as the outer cable winding speed. At the same time the differential gearing mechanism is responsive to operation of the drive means to drive the inner winching device at a speed defined as the inner cable winding speed. Preferably the outer cable winding speed is greater than the inner cable winding speed primarily required because of the additional mechanical advantage provided by the additional pulleys within the outer pulley assembly as compared to the inner main pulley.

In the preferred configuration the main drive is attached through the differential gearing to the outer winch for driving thereof.

Preferably the configuration of the differential gearing includes an outer sprocket secured to the outer winch and operative to be rotatable therewith. The differential gearing preferably also includes an inner sprocket secured to the inner winching device to be rotatable therewith. This inner sprocket is preferably larger than the outer sprocket to facilitate driving of the outer cable winding drum at cable winding speeds greater than the inner cable winding drum. A chain is preferably positioned in surrounding engagement with respect to the outer sprocket and the inner sprocket to cause driving of the inner sprocket responsive to driving of the outer sprocket by the main drive.

The configuration of the differential gearing mechanism defined above included an inner and outer sprocket with a chain means interconnecting therebetween. There are numerous other configurations which could be used for the differential gearing mechanism such as an outer gear means secured to the outer winching means and operative to be rotatable therewith as well as an inner gear means secured to the inner winching means and operative to be rotatable therewith. With this alternative configuration the inner gear will preferably be positioned in engagement with respect to the outer gear to be rotatable simultaneously therewith. With such a configuration the inner gear will preferably be larger than the outer gear to facilitate driving of the outer cable winding drum at cable winding speeds greater than the inner cable winding drum.

It is an object of the present invention to provide a topless watercraft lifting apparatus wherein maintenance requirements are minimized.

It is an object of the present invention to provide a topless watercraft lifting apparatus wherein down time is minimized.

It is an object of the present invention to provide a topless watercraft lifting apparatus wherein a number of moving parts is minimized.

It is an object of the present invention to provide a topless watercraft lifting apparatus wherein cable snapping is minimized.

It is an object of the present invention to provide a topless watercraft lifting apparatus wherein watercraft can be lifted to a substantial height removed from a body of water.

It is an object of the present invention to provide a topless watercraft lifting apparatus wherein one or more lifting beams can be maintained horizontal during vertical lifting of a watercraft from a body of water.

It is an object of the present invention to provide a topless watercraft lifting apparatus wherein the outer and inner end of a lifting beam are maintained horizontal with respect to one another while being driven by a single main drive powered through a differential to achieve different operating speeds for the inner and outer respective winches.

It is an object of the present invention to provide a topless watercraft lifting apparatus wherein the mass of the watercraft is distributed along the lifting beams.

It is an object of the present invention to provide a topless watercraft lifting apparatus wherein a grooved cylindrical winder sleeve is used with each winching mechanism in order to contain all of the necessary length of cable on one wrap layer.

It is an object of the present invention to provide a topless watercraft lifting apparatus wherein cable is wound such that it does not wind upon itself which tends to flatten and damage cable strands.

It is an object of the present invention to provide a topless watercraft lifting apparatus wherein two cable winders are utilized one for lifting the outer end of the lifting beam and one for lifting the inner end of the lifting beam.

It is an object of the present invention to provide a topless watercraft lifting apparatus wherein the cable winding mechanisms are vertically aligned with one another and with respect to the lifting beam to maintain cable orientation and minimize wear.

It is an object of the present invention to provide a topless watercraft lifting apparatus wherein lifting of watercraft as great as 16000 lbs. or greater is made possible.

It is an object of the present invention to provide a topless watercraft lifting apparatus wherein a pulley configuration is utilized to equalize the forces on the cables in order to maintain the lifting beam horizontal by providing total cable tensions equal at each end when a watercraft is located upon the lifting beam.

It is an object of the present invention to provide a topless watercraft lifting apparatus wherein a single main drive can apply different operating speeds to two winches through a differential gearing mechanism which can include directly engaged gear teeth on two separately rotatable wheels or can include two rotatable sprockets spaced apart from one another and interconnected by a flexible chain means.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
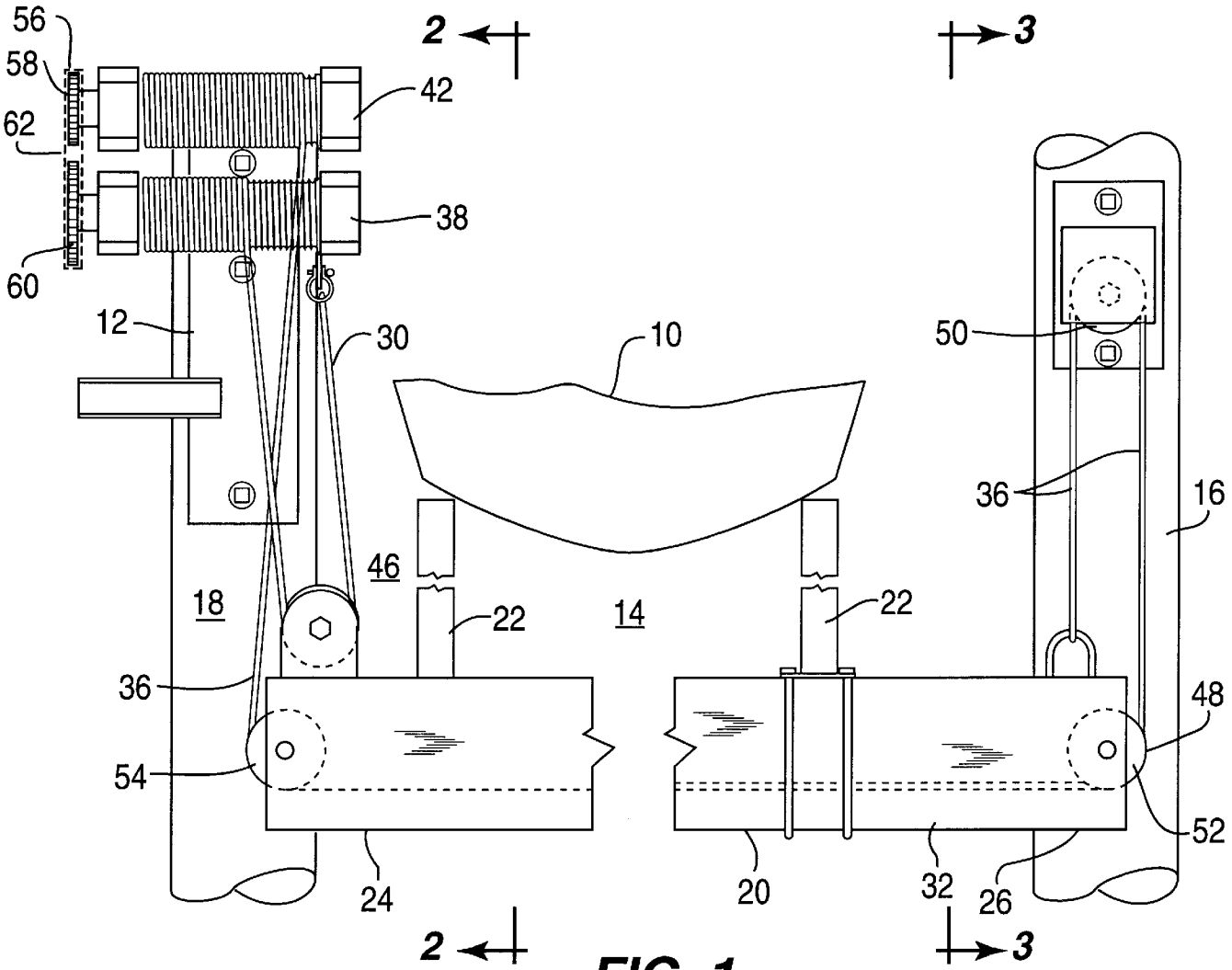
FIG. 1 is a front plan view of an embodiment of the topless watercraft lifting apparatus of the present invention.
Figure 2:
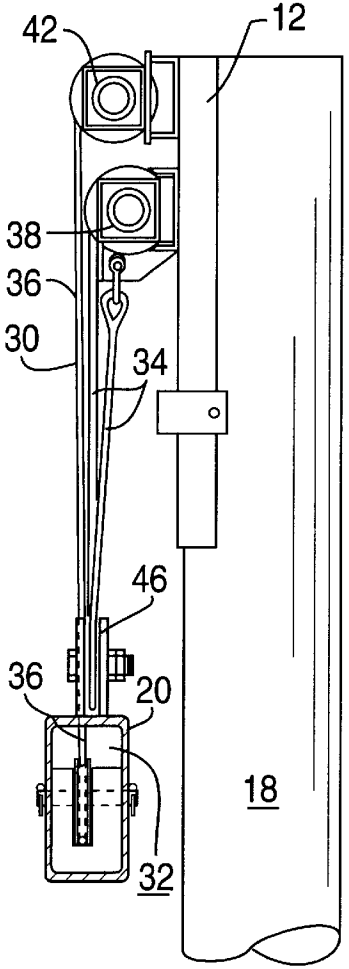
FIG. 2 is a side plan view of the embodiment shown in FIG. 1 as seen from the left.
Figure 3:
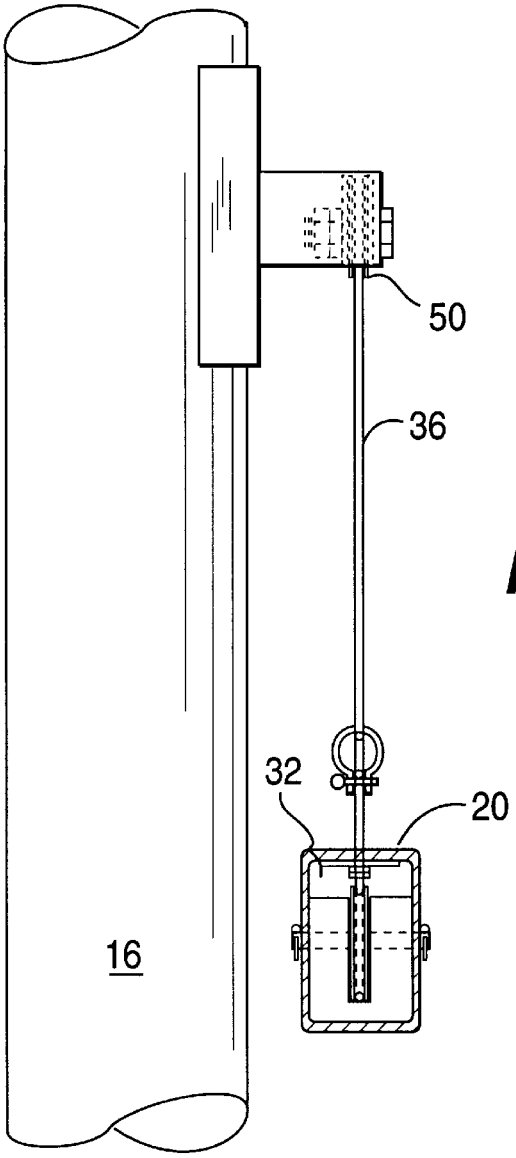
FIG. 3 is a side plan view of the embodiment shown in FIG. 1 as seen from the right.

The present invention provides a topless lifting apparatus for watercraft 10 which includes a main frame 12 designed to receive the watercraft 10 therewithin when ready for lifting thereof. Preferably the main frame 12 includes an outer piling means 16 and an inner piling means 18 which defines therebetween a watercraft receiving slot 14 sometimes referred to as a "slip".

The apparatus of the present invention includes a lifting beam 20 extending generally horizontally below the watercraft 10 when positioned within the watercraft receiving slot 14. The lifting beam 20 is vertically movable with respect to the main frame 12. Watercraft support members 22 are included extending upwardly from the lifting beam 20 and are adapted to engage the undersurface of the watercraft 10 to facilitate lifting thereof.

The lifting beam 20 preferably includes a proximate beam end 24 positioned adjacent the inner piling 18 and a distal beam end 26 positioned adjacent the outer piling 16.

A main drive 28 such as an electric motor may be secured with respect to the main frame 12 and is operative responsive to actuation thereof to cause vertical movement of the lifting beam 20 and the watercraft 10 positioned upon the watercraft support members 22 thereof.

Lifting means 30 preferably includes an inner winching means 38 which can include an inner cable winding drum 40 with an inner cable means 34 wound therearound and capable of winding or unwinding movement to control movement of said inner cable 34. Preferably the inner cable 34 is attached in some manner with respect to the proximate beam end 24 to control movement thereof.

In a similar manner lifting means 30 may include an outer winching means 42 which may include an outer cable winding drum 44 with an outer cable means 36 wound therearound. Operation of the outer winching means 42 is operative to wind or unwind outer cable 36 which itself is in any conventional manner attached with respect to the distal beam end 26 of lifting beam 20 in order to control vertical movement thereof.

Preferably the lifting means 30 includes an inner main pulley 46 which is rotatably secured to the proximate beam end 24 of lifting beam 20. With this configuration the inner cable 34 will extend from the inner cable winding drum 40 downwardly toward the proximate beam end 24 such that it can extend about the inner main pulley 46. The cable will then travel upwardly to be secured to the main frame 12 at a position adjacent the inner winching device 38. In this manner when the inner cable 34 is wound onto the inner cable winding drum 40 an upward force will be exerted on the proximate beam end 24 of the lifting beam 20.

An outer pulley assembly 48 is also utilized preferably to control positioning of the outer cable means 36 and the exertion of upward bias on the distal beam end 26 of lifting beam 20. Outer pulley assembly 48 preferably includes an outer main pulley 50 rotatably secured with respect to the distal beam end 26 as well as a proximate beam pulley 54 rotatably secured adjacent the proximate beam end 24.

In the configuration shown best in FIG. 1 the outer cable means 36 will selectively be cable of being wound upon the outer cable winding drum 44. Outer cable 36 will extend downwardly from the outer cable winding drum 44 to extend around the proximate beam pulley 54. It will then travel generally horizontally toward the distal beam 52 and will travel therearound also. The outer cable 36 will then travel upwardly and extend around the outer main pulley 50. It will then extend downwardly from pulley 50 and be attached adjacent the distal beam end 26 of lifting beam 20. With this configuration operation of the outer cable winding drum 44 which causes retracting of the outer cable 36 or wrapping thereof about drum 44 will cause vertical upward movement of the lifting beam 20.

Due to the mechanical advantage created by the several pulleys included in the outer pulley assembly 48 it is necessary in this embodiment that the outer cable winding drum 44 be operated at a greater cable winding speed than the cable winding speed of the inner cable winding drum 40 in order to maintain the proximate beam end 24 and the distal beam end 26 in horizontal orientation with respect to one another. For this reason a differential gearing means 56 is included.

Differential gearing means 56 preferably can be of any configuration which receives power and distributed it such that it causes a higher cable winding speed in one of the winch means 38 or 42. In the configuration shown in FIG. 1 a higher cable winding speed is required for the outer cable winding means in view of the mechanical advantage created by the pulleys over which the outer cable 36 extends. This differential gearing means 56 preferably will include an outer sprocket 58 as shown best in FIG. 1 secured to the outer winching means 42. In a similar manner an inner sprocket 60 will be secured with respect to the inner winching means 38. With the configuration shown in FIG. 1 it is preferable that the outer sprocket 58 be smaller or have fewer teeth than the inner sprocket 60 such that the outer cable winding drum 44 is driven at a higher speed than the inner cable winding drum 40. In the configuration shown in FIG. 1 the inner sprocket 60 is larger and has 24 teeth whereas the outer sprocket 58 is smaller and has only 16 teeth. As such, the operation of the main drive 28 will cause the outer cable winding drum 44 to run at a speed 50% greater than the inner cable winding drum 40 thereby maintaining the lifting beam 20 horizontally oriented with the proximate beam end 24 and the distal beam 26 at the same height.

Figure 4:
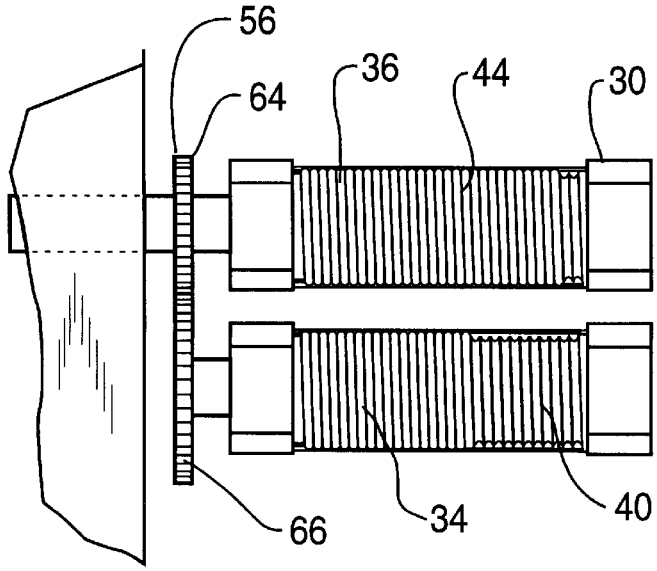
FIG. 4 is a view of an embodiment of the winching apparatus of the present invention and an embodiment of the differential mechanism thereof.

Interconnection between the outer sprocket 58 and the inner sprocket 60 is made possible by a chain means 62 in engagement therewith. It should be appreciated that other configurations can be utilized for the differential gearing mechanism 56 and another such mechanism is shown in FIG. 4. In FIG. 4 we see the outer sprocket 58 replaced with an outer gear means 64 and the inner sprocket 60 replaced with an inner gear means 66. Gears 64 and 66 are in engagement with respect to one another such as to be simultaneously rotatable.

In a preferred configuration the lifting beam 20 will define a lateral channel 32 extending therethrough. This channel is defined to receive the proximate beam pulley 54 rotatably secured therewithin adjacent the proximate beam end 24. Similarly, the distal beam pulley 52 is preferably rotatably secured with respect to the lifting beam 20 at a position adjacent the distal beam end 26 thereof within the lateral channel 32 defined therein. With this configuration it is preferable that the outer cable 36 will extend from the proximate beam pulley 54 to the distal beam pulley 52 through the lateral channel 32 defined in the lifting beam 20. This preferred configuration facilitates the lifting action necessary for vertically lifting a watercraft positioned upon the watercraft support 22 and for maintaining the lifting beam 20 in a horizontal orientation.

Figure 5:
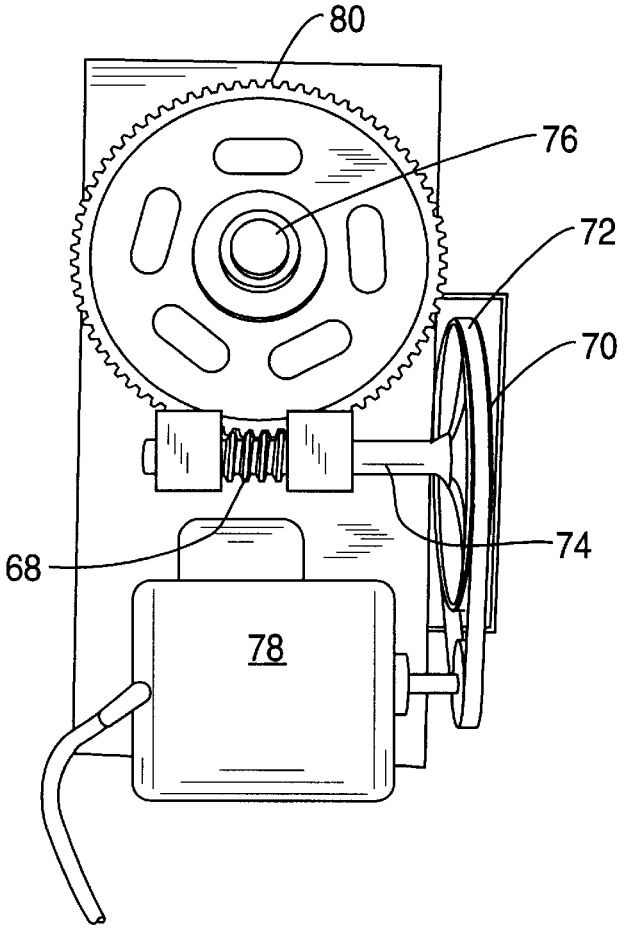
FIG. 5 is a side plan view of an embodiment of the driving means for use with the present invention.
Figure 6:
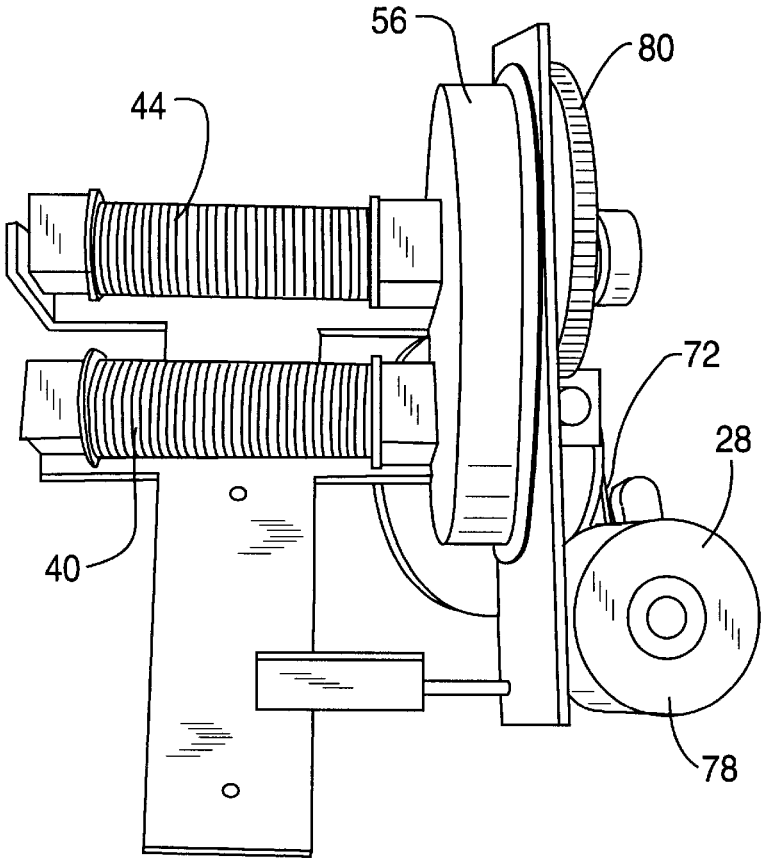
FIG. 6 is a front plan view of the embodiment shown in FIG. 5.

The configuration of the main drive 28 of the present invention can be of any convention design. However, one specific design configuration is shown in FIGS. 5 and 6. These figures show a drive motor 78 with the output thereof in driving engagement with a drive wheel 70 through a drive belt 72 which extends about both the drive wheel 70 and the output of drive motor 78. Drive wheel 70 is fixedly secured to a drive axle 74 which causes rotational movement of a worm gear 68. Worm gear 68 is in engagement with a gear wheel 80 which is fixedly secured to the driveshaft 76 of the outer cable winding drum 44. As such, operation of the drive motor 78 will cause driving of the driveshaft 76 of cable winding drum 44 causing movement of the gear or sprocket secured thereto resulting in differential driving of the inner cable winding drum 40 as well as of the outer cable winding drum 44 but at different operating speeds. These different operating speeds are caused by the sprocket or gearing configuration of the differential gearing means 56.

Figure 7:
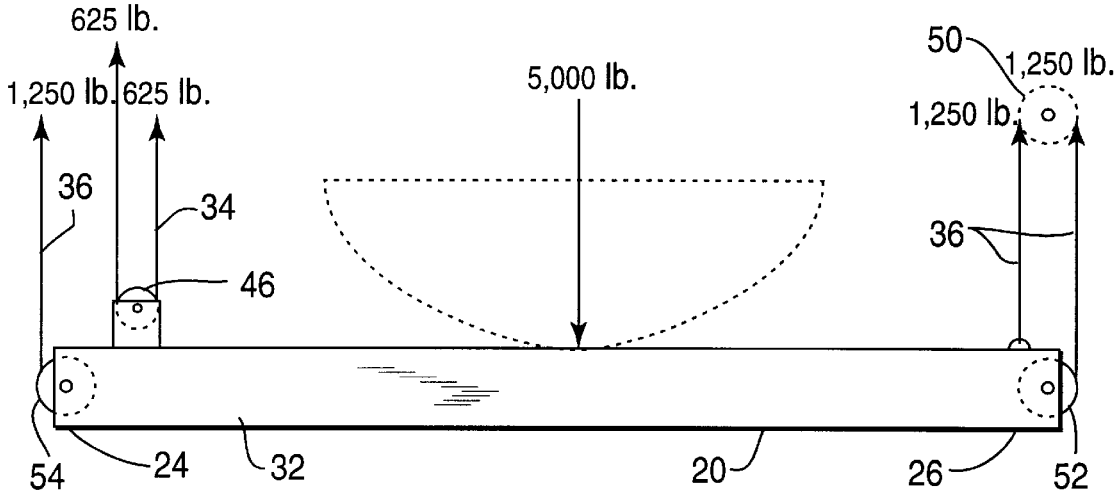
FIG. 7 is a vector diagram showing schematically the forces exerted upon the lifting beam and pulleys of an embodiment of the present invention.

FIG. 7 shows a vector diagram of the forces experienced by the apparatus of the present invention with a 5000 lb. load centrally positioned on the lifting beam 20. At the distal beam end 26 of lifting beam 20 the outer cable 36 will experience a 1250 lb. load between the fixed connection to the distal beam end 26 and the outer main pulley 50. A similar 1250 lb. load will be experienced by the distal beam end 26 between the outer main pulley 50 and the proximate beam pulley 54. As such, half of the centrally positioned load will be distributed by the lifting beam 20 to the distal beam end 26 thereof.

At the proximate beam end 24 a load of 1250 lbs. will be experienced between the proximate beam pulley 54 and the outer cable winding drum 44 thereabove. A partial load of 625 lbs. will be experienced between the inner main pulley 46 and the fixed connection thereof to the main frame 12. Similarly a partial loading of 625 lbs. will be experienced between the opposite side of the inner main pulley 46 and the inner cable winding drum 40 positioned thereabove. Thus we now see that the proximate beam end 24 will experience a total of one-half of the centrally located load or 2500 lbs. As such, we can determine that the weight will be equally distributed between the proximate beam end 24 and the distal beam end 26 and the lifting beam 20 will be maintained in a horizontal orientation during lifting movement.

In the preferred configuration of the present invention the watercraft support members 22 are laterally adjustable to accommodate various sizes of watercraft and preferably include a carpeted or other soft surface designed to abut the lower surface of the watercraft 10 without damaging thereof.

Figure 8:
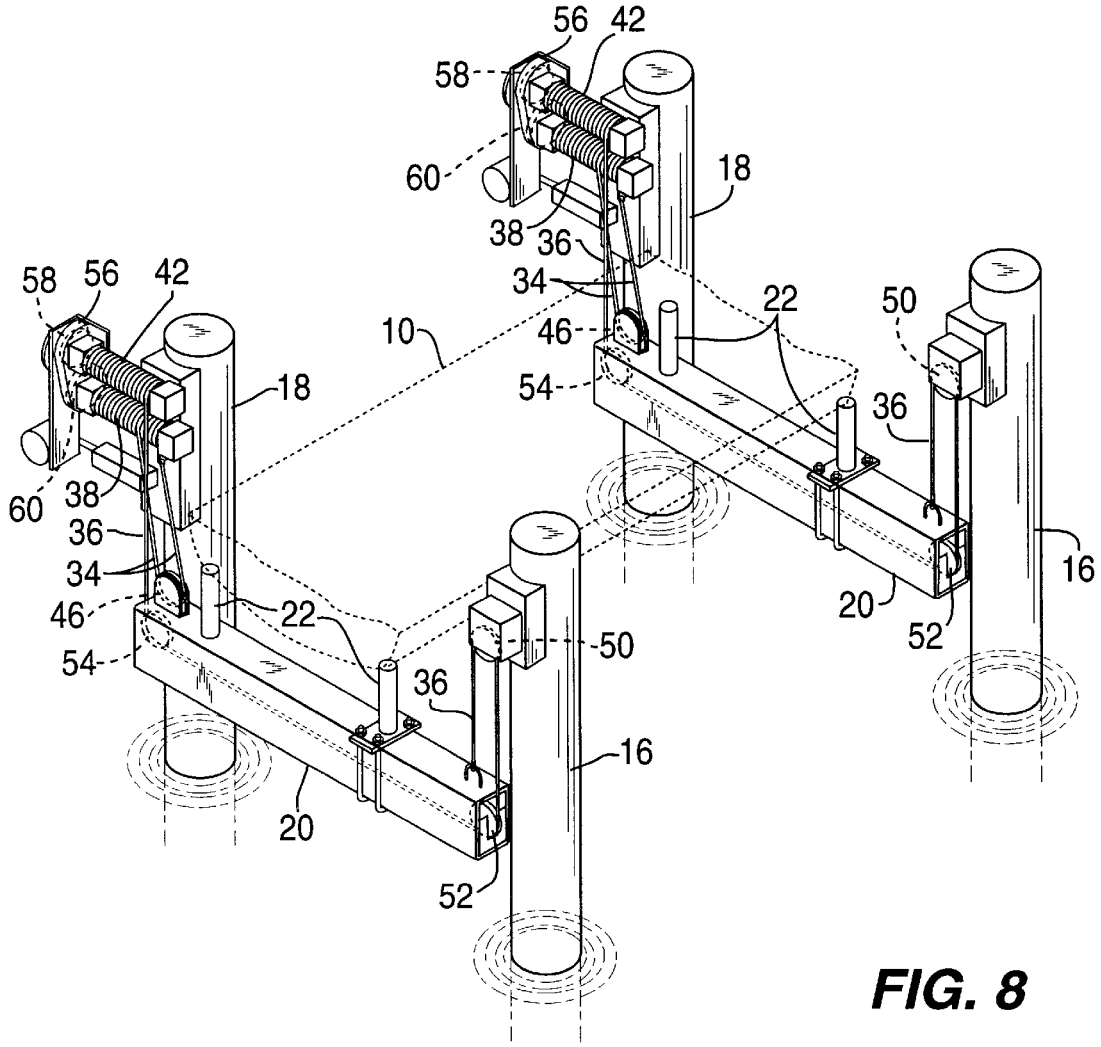
FIG. 8 is a perspective illustration of an embodiment of a topless watercraft lifting apparatus made in accordance with the present invention showing a first lifting mechanism in the foreground and a second lifting mechanism in the background.

It should be appreciated that the open top configuration of the watercraft lifting apparatus of the present invention is made possible by utilizing two cables with respect to each lifter beam. This novel apparatus can be used with a single lifting beam that is preferably utilized with two lifting beams as shown in FIG. 8. When using a single lifting beam sometimes problems can occur with regard to for and aft balancing and therefore two such lifting beams is the preferred configuration as shown in FIG. 8. One lifting configuration will be located beneath the front undersurface of the watercraft and a second will be positioned below the aft undersurface thereof to achieve overall balance. Each such lifting configuration can be positioned within the main frame 12 but each will have its own main drive 28, lifting means 30, pulley assemblies 46 and 48, and differential gearing means 56 and other similar associated parts. It should be appreciated, however, that any number of lifting beam configurations can be used to create and still come within the overall inventive concept of the present invention. One lifter beam may be usable with smaller loads. However, the most common configuration is clearly the use of two lifter beams as shown in FIG. 8. The open top aspect of this design is achievable by having two similarly configured winches, namely, winching means 38 and 42 both operated by a single drive means 28 but at different operating speeds wherein one of them allows a cable to pass along or through the lifting beam 20 to facilitate exerting an upward force against the distal beam end 26 of the lifting means 20. In this manner no overhead booms or lifts are necessary and a completely open top configuration can be made possible.

Also in the preferred configuration the outer cable winding drum 44 in vertical alignment with the inner cable winding drum 40 and both will be oriented immediately above and in vertical alignment with the proximate beam end 24 of the lifting beam 20. With this configuration excessive side stresses or tensions and/or deterioration of the cables is minimized.

While particular embodiments of this invention have been shown in the drawings and described above, it will be apparent, that many changes may be made in the form, arrangement and positioning or the various elements of the combination. In consideration thereof it should be understood that preferred embodiments of this invention disclosed herein are intended to be illustrative only and not intended to limit the scope of the invention.

I claim:

1. A topless watercraft lifting apparatus comprising:

A. a main frame means defining a watercraft receiving slot means therewithin for receiving a watercraft for lifting thereof;

B. a lifting beam means movably mounted within said main frame means and extending laterally across said watercraft receiving slot means therebelow and being vertically movable upwardly, said lifting beam means including;

(1) a watercraft support means positionable below a watercraft positioned within said watercraft receiving slot means and adapted to be in abutment therewith for facilitating lifting thereof;

(2) a proximate beam end on said lifting beam means;

(3) a distal beam end on said lifting beam means spatially disposed from said proximate beam end, said watercraft support means being located on said lifting beam means between said proximate beam end and said distal beam end thereof;

C. a main drive means secured to said main frame means;

D. a lifting means attached to said main frame means and operatively attached with respect to said lifting beam means and with respect to said main drive means for facilitating vertical movement of said lifting beam means responsive to operation of said main drive means, said lifting means including;

(1) an inner cable means operatively attached with respect to said proximate beam end of said lifting beam means to facilitate lifting thereof;

(2) an outer cable means operatively attached with respect to said distal beam end of said lifting beam means to facilitate lifting thereof;

(3) an inner winching means operatively attached to said inner cable means for selectively winding and unwinding thereof to facilitate control of lifting of said proximate beam end of said lifting beam means;

(4) an outer winching means operatively attached to said outer cable means for selectively winding and unwinding thereof to facilitate control of lifting of said distal beam end of said lifting beam means; and E. a differential gearing means operatively connected to said main drive means and also being operatively connected separately to each of said inner winching means and said outer winching means for facilitating driving thereto, said differential gearing means being responsive to operation of said main drive means to drive said outer winching means at an outer cable winding speed and to drive said inner winching means at an inner cable winding speed, said inner cable winding speed being different than said outer cable winding speed.

2. A topless watercraft lifting apparatus as defined in claim 1 wherein said differential gearing means is operative to drive said outer winching means at an outer cable winding speed greater than the inner cable winding speed at which said differential gearing means drives said inner winching means.

3. A topless watercraft lifting apparatus as defined in claim 1 wherein said inner winching means comprises an inner cable winding drum means and wherein said outer winching means comprises an outer cable winding drum means.

4. A topless watercraft lifting apparatus as defined in claim 3 wherein said outer cable winding drum means and said inner winding drum means are oriented vertically aligned with respect to one another and with respect to said lifting beam means therebelow to facilitate control of lifting thereof.

5. A topless watercraft lifting apparatus as defined in claim 1 wherein said inner cable winding drum means and said outer cable winding drum means are approximately equal in shape and size.

6. A topless watercraft lifting apparatus as defined in claim 1 wherein said main drive means is attached through said differential gearing means to said outer winching means for driving thereof and wherein said differential gearing means includes:

A. a first sprocket means secured to said outer winching means and operative to be driven therewith;

B. a second sprocket means secured to said inner winching means and operative to be driven therewith and of a size different than said first sprocket means; and C. a chain means in surrounding engagement with said first sprocket means and said second sprocket means to cause driving of said second sprocket means responsive to driving of said first sprocket means by said main drive means.

7. A topless watercraft lifting apparatus as defined in claim 6 wherein said second sprocket means is larger than said first sprocket means.

8. A topless watercraft lifting apparatus comprising:

A. a main frame means defining a watercraft receiving slot means therewithin for receiving a watercraft for lifting thereof;

B. a lifting beam means movably mounted within said main frame means and extending laterally across said watercraft receiving slot means therebelow and being vertically movable upwardly, said lifting beam means including;

(1) a watercraft support means positionable below a watercraft positioned within said watercraft receiving slot means and adapted to be in abutment therewith for facilitating lifting thereof;

(2) a proximate beam end on said lifting beam means;

(3) a distal beam end on said lifting beam means spatially disposed from said proximate beam end, said watercraft support means being located on said lifting beam means between said proximate beam end and said distal beam end thereof;

C. a main drive means secured to said main frame means;

D. a lifting means attached with respect to said main frame means and operatively attached with respect to said lifting beam means and with respect to said main drive means for facilitating vertical movement of said lifting beam means responsive to operation of said main drive means, said lifting means including;

(1) an inner cable means operatively attached with respect to said proximate beam end of said lifting beam means to facilitate lifting thereof;

(2) an outer cable means operatively attached with respect to said distal beam end of said lifting beam means to facilitate lifting thereof;

(3) an inner winching means operatively attached to said inner cable means for selectively winding and unwinding thereof to facilitate control of lifting of said proximate beam end of said lifting beam means, said inner winching means including an inner cable winding drum means;

(4) an outer winching means operatively attached to said outer cable means for selectively winding and unwinding thereof to facilitate control of lifting of said distal beam end of said lifting beam means, said outer winching means including an outer cable winding drum means, said outer cable winding drum means being vertically oriented with said inner cable winding drum means to facilitate control of lifting of said lifting beam means; and E. a differential gearing means operatively connected to said main drive means and also being operatively connected separately to each of said inner winching means and said outer winching means for facilitating driving thereto, said differential gearing means being responsive to operation of said main drive means to drive said outer winching means at an outer cable winding speed and to drive said inner winching means at an inner cable winding speed, said outer cable winding speed being greater than said inner cable winding speed.

9. A topless watercraft lifting apparatus as defined in claim 8 wherein said outer cable winding drum means is positioned above said inner cable winding drum means to facilitate controlling of movement of said lifting beam means therebelow.

10. A topless watercraft lifting apparatus as defined in claim 8 wherein said lifting means further comprises an inner main pulley rotatably secured to said lifting beam means adjacent said proximate beam end thereof and wherein said inner cable means extends from said inner cable winding drum means around said inner main pulley to be fixedly secured to said main frame means thereabove to facilitate vertical movement of said proximate beam end of said lifting beam means.

11. A topless watercraft lifting apparatus as defined in claim 8 wherein said lifting means further comprises an outer pulley assembly for facilitating vertical movement of said distal beam end of said lifting beam means.

12. A topless watercraft lifting apparatus as defined in claim 11 wherein said outer pulley assembly comprises:

A. an outer main pulley rotatably secured to said frame means above said distal beam end of said lifting beam means;

B. a distal beam pulley rotatably secured to said lifting beam means adjacent said distal beam end thereof; and C. a proximate beam pulley rotatably secured to said lifting beam means adjacent said proximate beam end thereof.

13. A topless watercraft lifting apparatus as defined in claim 12 wherein said outer cable means extends from said outer cable winding drum means around said proximate beam pulley and around said distal beam pulley and around said outer main pulley to attachment to said lifting beam means at a position adjacent said distal beam end thereof to facilitate vertical movement thereof.

14. A topless watercraft lifting apparatus as defined in claim 13 wherein said lifting beam means defines a lateral channel means extending therethrough.

15. A topless watercraft lifting apparatus as defined in claim 14 wherein said distal beam pulley and said proximate beam pulley are rotatably secured to said lifting beam means within said lateral channel means defined extending therethrough and wherein said outer cable means extends from said proximate beam pulley to said distal beam pulley therethrough.

16. A topless watercraft lifting apparatus as defined in claim 8 wherein said main drive means is attached through said differential gearing means to said outer winching means for driving thereof and wherein said differential gearing means includes:

A. a outer sprocket means secured to said outer winching means and operative to rotatable therewith;

B. a inner sprocket means secured to said inner winching means to be rotatable therewith, said inner sprocket means being larger than said outer sprocket means to facilitate driving of said outer cable winding drum means at cable winding speeds greater than said inner cable winding drum means; and C. a chain means in surrounding engagement with said outer sprocket means and said inner sprocket means to cause driving of said inner sprocket means responsive to driving of said outer sprocket means by said main drive means.

17. A topless watercraft lifting apparatus as defined in claim 16 wherein the outer circumference of said inner sprocket means is 50% greater than the outer circumference of said outer sprocket means.

18. A topless watercraft lifting apparatus as defined in claim 8 wherein said main drive means is attached through said differential gearing means to said outer winching means for driving thereof and wherein said differential gearing means includes:

A. a outer gear means secured to said outer winching means and operative to be rotatable therewith;

B. a inner gear means secured to said inner winching means and operative to be rotatable therewith, said inner gear means being positioned in engagement with said outer gear means to be rotatable therewith, said inner gear means being larger than said outer gear means to facilitate driving of said outer cable winding drum means at cable winding speeds greater than said inner cable winding drum means.

19. A topless watercraft lifting apparatus as defined in claim 8 wherein said frame means includes:

A. an outer piling means adjacent said distal beam end of said lifting beam means; and B. an inner piling means adjacent said proximate beam end of said lifting beam means, said inner piling means being spatially disposed from said outer piling means to define said watercraft receiving slot means therebetween.

20. A topless watercraft lifting apparatus comprising:

A. a main frame means defining a watercraft receiving slot means therewithin for receiving a watercraft for lifting thereof, said frame means including:

(1) an outer piling means;

(2) an inner piling means spatially disposed from said outer piling means to define said watercraft receiving slot means therebetween;

B. a lifting beam means movably mounted within said main frame means and extending laterally across said watercraft receiving slot means therebelow and being vertically movable upwardly, said lifting beam means defining a lateral channel means extending therethrough, said lifting beam means including;

(1) a watercraft support means positionable below a watercraft positioned within said watercraft receiving slot means and adapted to be in abutment therewith for facilitating lifting thereof;

(2) a proximate beam end on said lifting beam means positioned adjacent said inner piling means;

(3) a distal beam end on said lifting beam means spatially disposed from said proximate beam end and positioned adjacent said outer piling means, said watercraft support means being located on said lifting beam means between said proximate beam end and said distal beam end thereof;

C. a main drive means secured to said main frame means;

D. a lifting means attached with respect to said main frame means and operatively attached with respect to said lifting beam means and with respect to said main drive means for facilitating vertical movement of said lifting beam means responsive to operation of said main drive means, said lifting means including;

(1) an inner cable means operatively attached with respect to said proximate beam end of said lifting beam means to facilitate lifting thereof;

(2) an outer cable means operatively attached with respect to said distal beam end of said lifting beam means to facilitate lifting thereof;

(3) an inner winching means operatively attached to said inner cable means for selectively winding and unwinding thereof to facilitate control of lifting of said proximate beam end of said lifting beam means, said inner winching means including an inner cable winding drum means, said inner winching means being secured to said inner piling means;

(4) an outer winching means operatively attached to said outer cable means for selectively winding and unwinding thereof to facilitate control of lifting of said distal beam end of said lifting beam means, said outer winching means being secured to said outer piling means, said outer winching means including an outer cable winding drum means, said outer cable winding drum means being vertically oriented with said inner cable winding drum means to facilitate control of lifting of said lifting beam means, said outer cable winding drum means being positioned above said inner cable winding drum means to facilitate controlling of movement of said lifting beam means therebelow;

(5) an inner main pulley rotatably secured to said lifting beam means adjacent said proximate beam end thereof, said inner cable means being positioned extending from said inner cable winding drum means around said inner main pulley to be fixedly secured to said main frame means thereabove to facilitate vertical movement of said proximate beam end of said lifting beam means;

(6) an outer pulley assembly for facilitating vertical movement of said distal beam end of said lifting beam means, said outer pulley assembly including:

(a) an outer main pulley rotatably secured to said frame means above said distal beam end of said lifting beam means, said outer main pulley being rotatably secured to said outer piling means;

(b) a distal beam pulley rotatably secured to said lifting beam means within said lateral channel means thereof adjacent said distal beam end thereof;

(c) a proximate beam pulley rotatably secured to said lifting beam means within said lateral channel means thereof adjacent said proximate beam end thereof, said outer cable means positioned extending from said outer cable winding drum means around said proximate beam pulley and through said lateral channel means to around said distal beam pulley and around said outer main pulley to attachment to said lifting beam means at a position adjacent said distal beam end thereof to facilitate vertical movement thereof; and E. a differential gearing means operatively connected to said main drive means and also being operatively connected separately to each of said inner winching means and said outer winching means for facilitating driving thereto, said differential gearing means being responsive to operation of said main drive means to drive said outer winching means at an outer cable winding speed and to drive said inner winching means at an inner cable winding speed, said outer cable winding speed being greater than said inner cable winding speed, said main drive means being attached through said differential gearing means to said outer winching means for driving thereof and wherein said differential gearing means includes:

(1) a outer sprocket means secured to said outer winching means and operative to rotatable therewith;

(2) a inner sprocket means secured to said inner winching means to be rotatable therewith, said inner sprocket means being larger than said outer sprocket means to facilitate driving of said outer cable winding drum means at cable winding speeds greater than said inner cable winding drum means; and (3) a chain means in surrounding engagement with respect to said outer sprocket means and said inner sprocket means to cause driving of said inner sprocket means responsive to driving of said outer sprocket means by said main drive means.

21. A topless watercraft lifting apparatus comprising:

A. a main frame means defining a watercraft receiving slot means therewithin for receiving a watercraft for lifting thereof, said frame means including:

(1) a first outer piling means;

(2) a first inner piling means spatially disposed from said first outer piling means to define said watercraft receiving slot means therebetween;

(3) a second outer piling means spatially disposed from said first outer piling means to facilitate lifting of a watercraft therebetween;

(4) a second inner piling means spatially disposed from said second outer piling means to further define said watercraft receiving slot means therebetween and being also spatially disposed from said first inner piling means to facilitate lifting of a watercraft therebetween;

B. a first lifting beam means movably mounted within said main frame means and extending laterally across said watercraft receiving slot means therebelow and being vertically movable upwardly, said first lifting beam means defining a first lateral channel means extending therethrough, said first lifting beam means including;

(1) a first watercraft support means positionable below a watercraft positioned within said watercraft receiving slot means and adapted to be in abutment therewith for facilitating lifting thereof;

(2) a first proximate beam end on said first lifting beam means positioned adjacent said first inner piling means;

(3) a first distal beam end on said first lifting beam means spatially disposed from said first proximate beam end and positioned adjacent said first outer piling means, said first watercraft support means being located on said first lifting beam means between said first proximate beam end and said first distal beam end thereof;

C. a first main drive means secured to said main frame means;

D. a first lifting means attached with respect to said main frame means and operatively attached with respect to said first lifting beam means and with respect to said main drive means for facilitating vertical movement of said first lifting beam means responsive to operation of said first main drive means, said first lifting means including;

(1) a first inner cable means operatively attached with respect to said first proximate beam end of said first lifting beam means to facilitate lifting thereof;

(2) an first outer cable means operatively attached with respect to said first distal beam end of said first lifting beam means to facilitate lifting thereof;

(3) a first inner winching means operatively attached to said first inner cable means for selectively winding and unwinding thereof to facilitate control of lifting of said first proximate beam end of said lifting beam means, said first inner winching means including a first inner cable winding drum means, said first inner winching means being secured to said first inner piling means;

(4) an first outer winching means operatively attached to said first outer cable means for selectively winding and unwinding thereof to facilitate control of lifting of said first distal beam end of said first lifting beam means, said first outer winching means being secured to said first inner piling means, said first outer winching means including a first outer cable winding drum means, said first outer cable winding drum means being vertically oriented with said first inner cable winding drum means to facilitate control of lifting of said first lifting beam means, said first outer cable winding drum means being positioned above said first inner cable winding drum means to facilitate controlling of movement of said first lifting beam means therebelow;

(5) an first inner main pulley rotatably secured to said first lifting beam means adjacent said first proximate beam end thereof, said first inner cable means being positioned extending from said first inner cable winding drum means around said first inner main pulley to be fixedly secured to said main frame means thereabove to facilitate vertical movement of said first proximate beam end of said first lifting beam means;

(6) an first outer pulley assembly for facilitating vertical movement of said first distal beam end of said first lifting beam means, said first outer pulley assembly including:

(a) a first outer main pulley rotatably secured to said frame means above said first distal beam end of said first lifting beam means, said first outer main pulley being rotatably secured to said first outer piling means;

(b) a first distal beam pulley rotatably secured to said first lifting beam means within said first lateral channel means thereof adjacent said first distal beam end thereof;

(c) a first proximate beam pulley rotatably secured to said first lifting beam means within said first lateral channel means thereof adjacent said first proximate beam end thereof, said first outer cable means positioned extending from said first outer cable winding drum means around said first proximate beam pulley and through said first lateral channel means to around said first distal beam pulley and around said first outer main pulley to attachment to said first lifting beam means at a position adjacent said first distal beam end thereof to facilitate vertical movement thereof; and E. a first differential gearing means operatively connected to said first main drive means and also being operatively connected separately to each of said first inner winching means and said first outer winching means for facilitating driving thereto, said first differential gearing means being responsive to operation of said first main drive means to drive said first outer winching means at a first outer cable winding speed and to drive said first inner winching means at an first inner cable winding speed, said first outer cable winding speed being greater than said first inner cable winding speed, said first main drive means being attached through said first differential gearing means to said first outer winching means for driving thereof and wherein said first differential gearing means includes:

(1) a first outer sprocket means secured to said first outer winching means and operative to be rotatable therewith;

(2) a first inner sprocket means secured to said first inner winching means to be rotatable therewith, said first inner sprocket means being larger than said first outer sprocket means to facilitate driving of said first outer cable winding drum means at cable winding speeds greater than said first inner cable winding drum means;

(3) a first chain means in surrounding engagement with respect to said first outer sprocket means and said first inner sprocket means to cause driving of said first inner sprocket means responsive to driving of said first outer sprocket means by said first main drive means;

F. a second lifting beam means movably mounted within said main frame means and extending laterally across said watercraft receiving slot means therebelow and being vertically movable upwardly, said second lifting beam means defining a second lateral channel means extending therethrough, said second lifting beam means including;

(1) a second watercraft support means positionable below a watercraft positioned within said watercraft receiving slot means and adapted to be in abutment therewith for facilitating lifting thereof;

(2) a second proximate beam end on said second lifting beam means positioned adjacent said second inner piling means;

(3) a second distal beam end on said second lifting beam means spatially disposed from said second proximate beam end and positioned adjacent said second outer piling means, said second watercraft support means being located on said second lifting beam means between said second proximate beam end and said second distal beam end thereof;

G. a second main drive means secured to said main frame means;

H. a second lifting means attached with respect to said main frame means and operatively attached with respect to said second lifting beam means and with respect to said main drive means for facilitating vertical movement of said second lifting beam means responsive to operation of said second main drive means, said second lifting means including;

(1) a second inner cable means operatively attached with respect to said second proximate beam end of said second lifting beam means to facilitate lifting thereof;

(2) an second outer cable means operatively attached with respect to said second distal beam end of said second lifting beam means to facilitate lifting thereof;

(3) a second inner winching means operatively attached to said second inner cable means for selectively winding and unwinding thereof to facilitate control of lifting of said second proximate beam end of said lifting beam means, said second inner winching means including a second inner cable winding drum means, said second inner winching means being secured to said second inner piling means;

(4) an second outer winching means operatively attached to said second outer cable means for selectively winding and unwinding thereof to facilitate control of lifting of said second distal beam end of said second lifting beam means, said second outer winching means being secured to said second inner piling means, said second outer winching means including a second outer cable winding drum means, said second outer cable winding drum means being vertically oriented with said second inner cable winding drum means to facilitate control of lifting of said second lifting beam means, said second outer cable winding drum means being positioned above said second inner cable winding drum means to facilitate controlling of movement of said second lifting beam means therebelow;

(5) an second inner main pulley rotatably secured to said second lifting beam means adjacent said second proximate beam end thereof, said second inner cable means being positioned extending from said second inner cable winding drum means around said second inner main pulley to be fixedly secured to said main frame means thereabove to facilitate vertical movement of said second proximate beam end of said second lifting beam means;

(6) an second outer pulley assembly for facilitating vertical movement of said second distal beam end of said second lifting beam means, said second outer pulley assembly including:

(a) a second outer main pulley rotatably secured to said frame means above said second distal beam end of said second lifting beam means, said second outer main pulley being rotatably secured to said second outer piling means;

(b) a second distal beam pulley rotatably secured to said second lifting beam means within said second lateral channel means thereof adjacent said second distal beam end thereof;

(c) a second proximate beam pulley rotatably secured to said second lifting beam means within said second lateral channel means thereof adjacent said second proximate beam end thereof, said second outer cable means positioned extending from said second outer cable winding drum means around said second proximate beam pulley and through said second lateral channel means to around said second distal beam pulley and around said second outer main pulley to attachment to said second lifting beam means at a position adjacent said second distal beam end thereof to facilitate vertical movement thereof; and I. a second differential gearing means operatively connected to said second main drive means and also being operatively connected separately to each of said second inner winching means and said second outer winching means for facilitating driving thereto, said second differential gearing means being responsive to operation of said second main drive means to drive said second outer winching means at a second outer cable winding speed and to drive said second inner winching means at an second inner cable winding speed, said second outer cable winding speed being greater than said second inner cable winding speed, said second main drive means being attached through said second differential gearing means to said second outer winching means for driving thereof and wherein said second differential gearing means includes:

(1) a second outer sprocket means secured to said second outer winching means and operative to be rotatable therewith;

(2) a second inner sprocket means secured to said second inner winching means to be rotatable therewith, said second inner sprocket means being larger than said second outer sprocket means to facilitate driving of said second outer cable winding drum means at cable winding speeds greater than said second inner cable winding drum means; and (3) a second chain means in surrounding engagement with respect to said second outer sprocket means and said second inner sprocket means to cause driving of said second inner sprocket means responsive to driving of said second outer sprocket means by said second main drive means.

22. A topless watercraft lifting apparatus comprising:

A. a main frame means defining a watercraft receiving slot means therewithin for receiving a watercraft for lifting thereof, said frame means including:

(1) an outer piling means adjacent said distal beam end of said lifting beam means;

(2) an inner piling means adjacent said proximate beam end of said lifting beam means, said inner piling means being spatially disposed from said outer piling means to define said watercraft receiving slot means therebetween;

B. a lifting beam means movably mounted within said main frame means and extending across said watercraft receiving slot means therebelow and being vertically movable upwardly, said lifting beam means including;

(1) a watercraft support means positionable below a watercraft positioned within said watercraft receiving slot means and adapted to be in abutment therewith for facilitating lifting thereof;

(2) a proximate beam end on said lifting beam means;

(3) a distal beam end on said lifting beam means spatially disposed from said proximate beam end, said watercraft support means being located on said lifting beam means between said proximate beam end and said distal beam end thereof;

C. a main drive means secured to said main frame means;

D. a lifting means attached to said main frame means and operatively attached with respect to said lifting beam means and with respect to said main drive means for facilitating vertical movement of said lifting beam means responsive to operation of said main drive means, said lifting means including;

(1) an inner cable means operatively attached with respect to said proximate beam end of said lifting beam means to facilitate lifting thereof;

(2) an outer cable means operatively attached with respect to said distal beam end of said lifting beam means to facilitate lifting thereof;

(3) an inner winching means attached to said inner piling means, said inner winching means being operatively attached to said inner cable means for selectively winding and unwinding thereof to facilitate control of lifting of said proximate beam end of said lifting beam means;

(4) an outer winching means attached to said inner piling means, said outer winching means being operatively attached to said outer cable means for selectively winding and unwinding thereof to facilitate control of lifting of said distal beam end of said lifting beam means; and E. a differential gearing means operatively connected to said main drive means and also being operatively connected separately to each of said inner winching means and said outer winching means for facilitating driving thereto, said differential gearing means being responsive to operation of said main drive means to drive said outer winching means at an outer cable winding speed and to drive said inner winching means at an inner cable winding speed.

23. A topless watercraft lifting apparatus as defined in claim 22 wherein said inner cable winding speed is different than said outer cable winding speed.

24. A topless watercraft lifting apparatus as defined in claim 23 wherein said outer cable winding speed is greater than said inner cable winding speed.

25. A topless watercraft lifting apparatus as defined in claim 22 wherein said inner winching means and said outer winching means are vertically oriented with respect to each other.

26. A topless watercraft lifting apparatus as defined in claim 25 wherein said inner winching means is positioned immediately above said outer winching means to be vertically oriented therewith.

27. A topless watercraft lifting apparatus as defined in claim 25 wherein said outer winching means is positioned immediately above said inner winching means to be vertically oriented therewith.

* * * * *